US007166047B2

(12) United States Patent
May et al.

(10) Patent No.: US 7,166,047 B2
(45) Date of Patent: Jan. 23, 2007

(54) TOY BALL

(75) Inventors: Jerry A. May, Colden, NY (US); John F. Rhein, Hamburg, NY (US)

(73) Assignee: Mattel, Inc., El Segundo, CA (US)

( * ) Notice: Subject to any disclaimer, the term of this patent is extended or adjusted under 35 U.S.C. 154(b) by 107 days.

(21) Appl. No.: 10/961,053

(22) Filed: Oct. 12, 2004

(65) Prior Publication Data

US 2006/0079355 A1 Apr. 13, 2006

(51) Int. Cl.
*A63B 39/08* (2006.01)

(52) U.S. Cl. ..... 473/569; 473/596

(58) Field of Classification Search ..... 473/569–571, 473/575, 594, 596, 577, 610, 597, 600; 273/153 S, 273/155, 156; 446/268, 269, 122, 124
See application file for complete search history.

(56) References Cited

U.S. PATENT DOCUMENTS

| | | | | |
|---|---|---|---|---|
| 21,444 | A | 9/1858 | Rogers et al. | |
| 183,549 | A | 10/1876 | Dunham | |
| 354,269 | A | 12/1886 | Teichmann | |
| 508,558 | A | 11/1893 | Tate | |
| 955,435 | A | 4/1910 | Reed | |
| 1,258,464 | A | 3/1918 | Riley | |
| 1,513,773 | A | 11/1924 | Thompson | |
| 2,351,762 | A | 6/1944 | Hoover | |
| D157,464 | S | 2/1950 | Biggs | |
| 2,504,650 | A | 4/1950 | Chessrown | |
| 2,519,248 | A | 8/1950 | Hulbert | |
| 2,942,379 | A | 6/1960 | Oman et al. | |
| 2,949,697 | A | 8/1960 | Licitis et al. | |
| D190,036 | S | 4/1961 | Lakin | |
| 3,058,261 | A | 10/1962 | Lakin | |
| 3,228,686 | A | 1/1966 | Faulkner | |
| 3,694,648 | A | 9/1972 | Yates | |
| 3,798,835 | A | 3/1974 | McKeehan | |
| 3,804,411 | A * | 4/1974 | Hendry | 473/570 |
| 3,937,467 | A | 2/1976 | Benson et al. | |
| 4,129,963 | A | 12/1978 | Perry | |
| 4,150,810 | A * | 4/1979 | Laignel et al. | 251/309 |

(Continued)

FOREIGN PATENT DOCUMENTS

| | | |
|---|---|---|
| DE | 112266 | 9/1899 |

(Continued)

OTHER PUBLICATIONS

First Years Follow Me Fun Ball, Catalog # 535272, ASIN; B0001EJK9M, http://www.target.com/gp/detail.html/sr=2_i/qid=1097508378/ref=sr_1/602-6172163-3918244?%5Fencoding=UTF8&asin=B0001EJK9M, Jun. 1, 2004.

*Primary Examiner*—Steven Wong
(74) *Attorney, Agent, or Firm*—Edell Shapiro & Finnan, LLC

(57) ABSTRACT

A toy ball is formed from two shells and a pair of lock mechanisms 220. During construction, the shells, which may be hemispherical, are mated together and then the lock mechanisms are secured to the shells to form a substantially smooth-surfaced sphere. The lock mechanisms provide a redundant locking feature to hold the two shells together to form the toy ball.

36 Claims, 9 Drawing Sheets

U.S. PATENT DOCUMENTS

| | | | | |
|---|---|---|---|---|
| 4,203,251 | A | 5/1980 | Malek et al. | |
| 4,272,911 | A | 6/1981 | Strauss | |
| 4,381,620 | A | 5/1983 | Panzarella | |
| D274,070 | S | 5/1984 | Ma | |
| D282,950 | S | 3/1986 | Adams | |
| 4,592,936 | A | 6/1986 | Ferguson | |
| 4,601,675 | A | 7/1986 | Robinson | |
| 4,641,839 | A | 2/1987 | Turner | |
| 4,645,471 | A | 2/1987 | Herring et al. | |
| 4,652,980 | A | 3/1987 | Segan | |
| 4,726,800 | A * | 2/1988 | Kobayashi | 473/570 |
| D314,598 | S | 2/1991 | Capper et al. | |
| 4,991,847 | A * | 2/1991 | Rudell et al. | 473/594 |
| 5,145,473 | A | 9/1992 | Henry | |
| 5,476,408 | A | 12/1995 | Hoeting et al. | |
| 5,816,571 | A * | 10/1998 | Chen | 273/153 S |
| D414,534 | S | 9/1999 | Takahashi | |
| 6,073,581 | A * | 6/2000 | Wang | 473/594 |
| 6,117,030 | A * | 9/2000 | Green, Sr. | 473/570 |
| D471,608 | S | 3/2003 | Hettinger et al. | |
| 6,883,802 | B2 * | 4/2005 | Rom | 273/153 S |
| 2002/0123390 | A1 | 9/2002 | Byrne et al. | |

FOREIGN PATENT DOCUMENTS

| | | |
|---|---|---|
| DE | 19617434 A1 | 11/1996 |
| GB | 2150839 | 7/1985 |

* cited by examiner

TOY BALL

CROSS REFERENCE TO RELATED APPLICATIONS

This application is related to three design applications filed under separate covers entitled "TOY BALL WITH VISUALLY INTEGRATED END CAPS", "TOY BALL WITH END CAPS", and "END CAPS FOR A TOY BALL".

FIELD OF THE INVENTION

The present invention relates to a toy ball and, more particularly, to a substantially transparent toy ball with an entertainment element disposed within the ball, wherein the toy ball includes opaque end caps that safely secure the two hemispherical portions of the toy ball together.

BACKGROUND

Children enjoy toys that can captivate their attention. A toy ball is a particular play item that has endured the test of time and remained a favorite with children of all ages (infants, toddlers, etc.).

However, as with any child's toy, some intrinsic dangers must be avoided. According to the U.S. Consumer Product Safety Commission, small objects can easily be lodged in the airway of young children, creating a choking hazard. Thus, it is imperative to create toy balls that are increasingly safe for use by children.

Furthermore, a toy ball is often constructed from more than one base component (e.g., two half-spherical (hemispherical) shells that may be attached together to form a substantially spherical shell) in order to form a spherical structure. If these components that are used to construct the toy balls also contain small parts, they may create additional choking hazards to children in the event they come free during use. Thus, the particular construction of the components making up the toy ball must be considered so as to ensure safe use by children.

In addition, ancillary entertainment features are often incorporated into toy balls (e.g., figurines, rattling elements, fluids, etc.) in order to further captivate and hold a child's attention. Such ancillary features are intended to be stimulating and aesthetically pleasing so as to maintain the attention span of most children. It should be noted, however, that some of these ancillary entertainment features may be sufficiently small in size so as to pose a potential choking hazard to children.

Children sometimes play in rough manner. Thus, toys should generally be constructed so as to minimize the risk of damage during the normal course of play. In the instant case, a toy ball is sometimes subjected to rough play. A toy ball is subject to a plethora of physical activities (e.g., being thrown, rolled, dropped, hit, batted, etc.). Should a toy ball be broken apart in the course of play, the contents within the ball would be exposed/set free and, as such, the freed contents may constitute a risk to the safety of children playing with the toy. Additionally, the broken toy would be rendered unfit for future use.

Prior art toy balls typically are constructed from two shell halves mated together to form a seam along an equator of the toy ball. Such prior art toy balls are illustrated in U.S. Design Pat. No. 274,070 to Ma, U.S. Design Pat. No. 190,036 to Lakin, U.S. Design Pat. No. 314,598 to Capper et al. (illustrated in FIG. 1), U.S. Pat. No. 4,272,911 to Strauss, U.S. Pat. No. 2,519,248 to Hulbert, and U.S. Pat. No. 2,351,762 to Hoover. The method of affixing one shell half to another can include but are not limited to cementing, heat-sealing, ultrasonic welding, and dielectric welding. Still other toys have a substantially formed sphere, with an opening to insert an additional entertainment item, and are then capped to encapsulate the item within the sphere. An example of such a prior art toy ball is illustrated in U.S. Pat. No. 4,601,675 to Robinson.

During rough play, the toy balls have an increased risk of breaking open. The toy balls found in the prior art are not inherently resistant to forces acting perpendicular to the seam running along the ball's equator. More specifically, the equatorial seam provides little resistance to a shearing force applied at the seam or to tensile forces acting on the two shells perpendicular to the seam. Thus, it would be desirable to provide toy balls with a greater factor of safety for children. In particular, it would be desirable to provide a toy ball that possesses additional strength to withstand shearing forces acting on the seam of the toy ball. Additionally, it would be desirable to provide a toy ball that possesses additional strength to withstand tensile forces acting on the two shells perpendicular to the seam. Such additional strength would enhance the intrinsic value of a toy by providing an additional level of safety for children. Furthermore, while the addition of an element to structurally strengthen the toy ball is desired, any such element should not detract from the aesthetically pleasing nature of the toy ball to a child.

Thus, there exists a need for providing a toy ball that has a construction that adds strength to the ball's seam in order to prevent the toy ball from breaking open and exposing its contents to the child playing with the ball. Furthermore, any additional element incorporated into the construction of the toy ball should be generally aesthetically pleasing to a child. Providing such an arrangement that both increases the toy's safety and makes the toy more aesthetically desirable not only increases a child's enjoyment, but also increases the attractiveness of the toy to anyone concerned with the safety of children.

This invention is directed generally to a toy ball with additional strength to resist forces in a tensile direction or shearing forces applied to a main seam. More specifically, this invention is directed to a toy ball having two shells (hemispherical or unequal in size) fused together forming a seam, the toy ball also having opposing end caps, each end cap capturing a portion of each shell to resist both shearing and tensile forces acting on the seam.

SUMMARY OF THE INVENTION

Generally, the embodiments of the present invention provide a children's toy ball and, more particularly, a toy ball with an improved resistance to tensile and shearing forces acting on the connection points of the components used to construct the toy ball.

BRIEF DESCRIPTION OF THE DRAWINGS

Like reference numerals have been used to identify like elements throughout this disclosure.

DETAILED DESCRIPTION

In accordance with the present invention, the construction of a children's toy ball is disclosed. An embodiment of the toy ball of the present invention comprises two hemispherical shells adapted to be connected along a seam to form a sphere. A lock mechanism is attached to the sphere such that a portion of both hemispherical shells is captured by the lock mechanism. Disposed within the sphere is an entertainment item to stimulate the attention of children.

Figure 1:
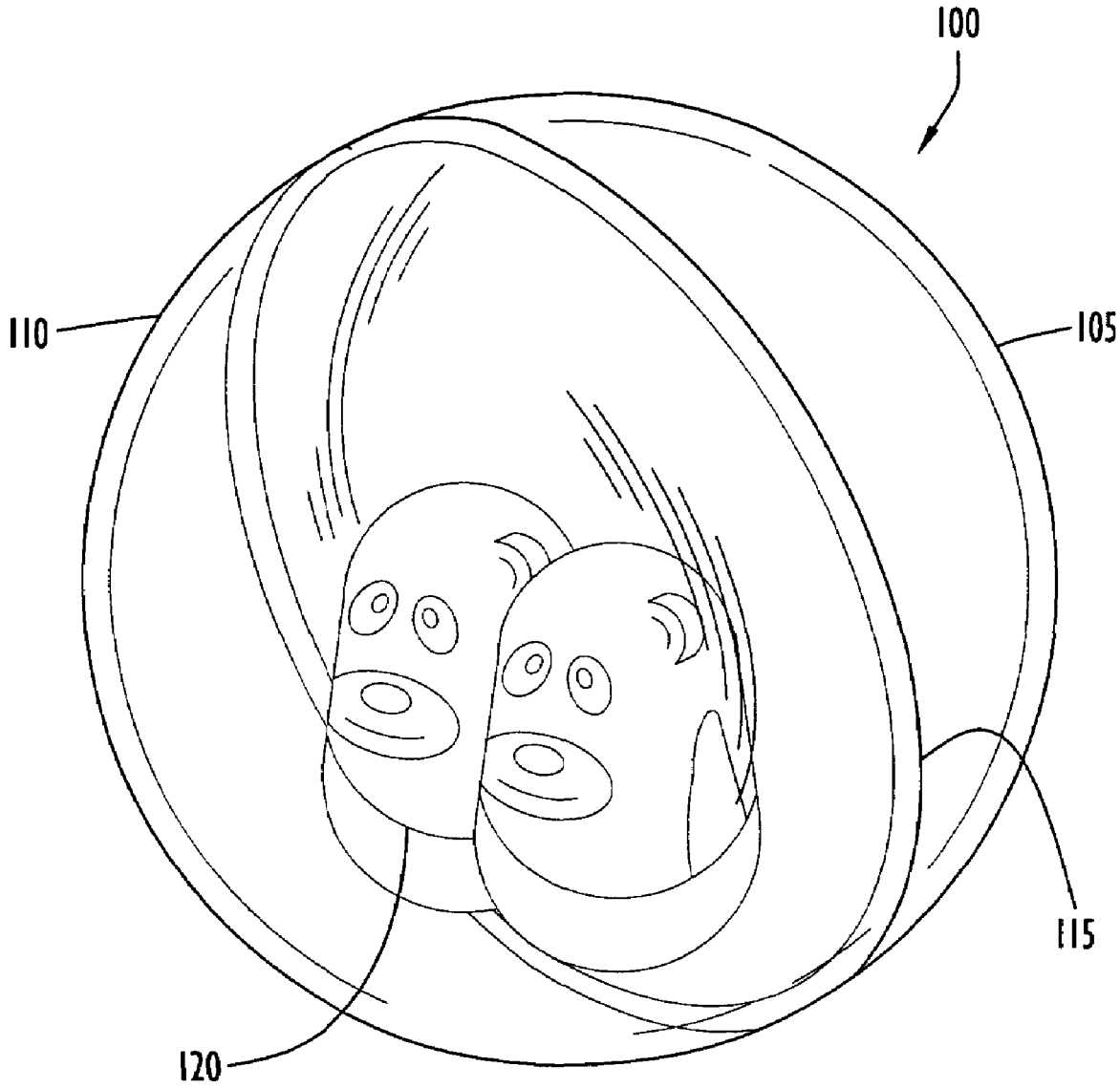
FIG.1 PRIOR ART
FIG. 1 illustrates a perspective view of a toy ball with an internal entertainment feature according to the prior art.

FIG. 1 illustrates a perspective view of a prior art toy ball 100. Toy ball 100 is constructed from two hemispherical shells 105, 110. Hemispherical shells 105, 110 are mated together along their outer circumference to form toy ball 100. When fused together, hemispherical shells 105, 110 form an equatorial seam line 115 that runs continuously along the outer circumference of toy ball 100. Hemispherical shells 105, 110 are constructed of a transparent material that permits a user to view inside toy ball 100. Freely moveable entertainment item 120 is normally disposed within toy ball 100 and viewable through the transparent material of hemispherical shells 105, 110.

Figure 2:
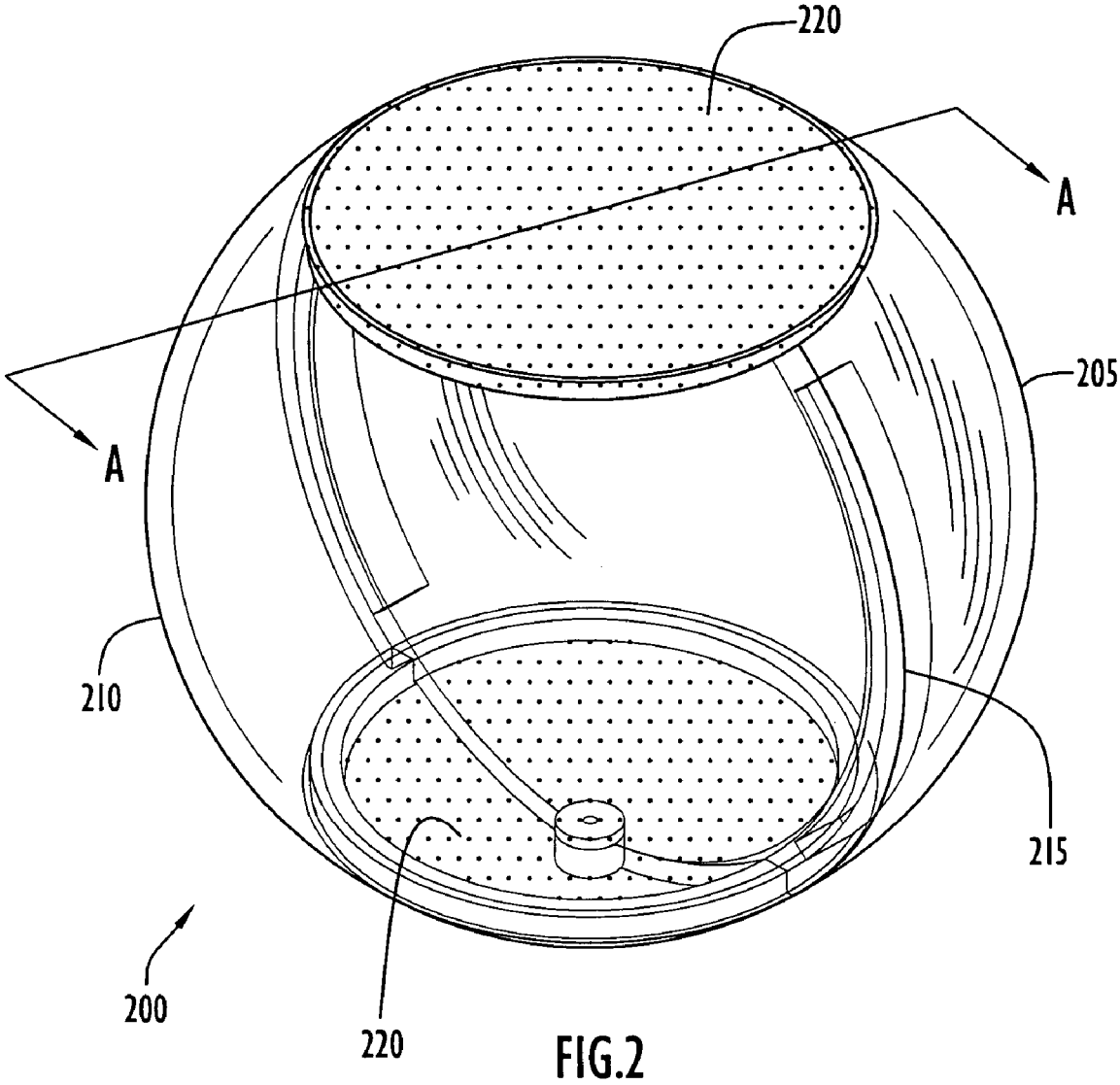
FIG. 2 illustrates a perspective view of an embodiment of the present invention.
Figure 3:
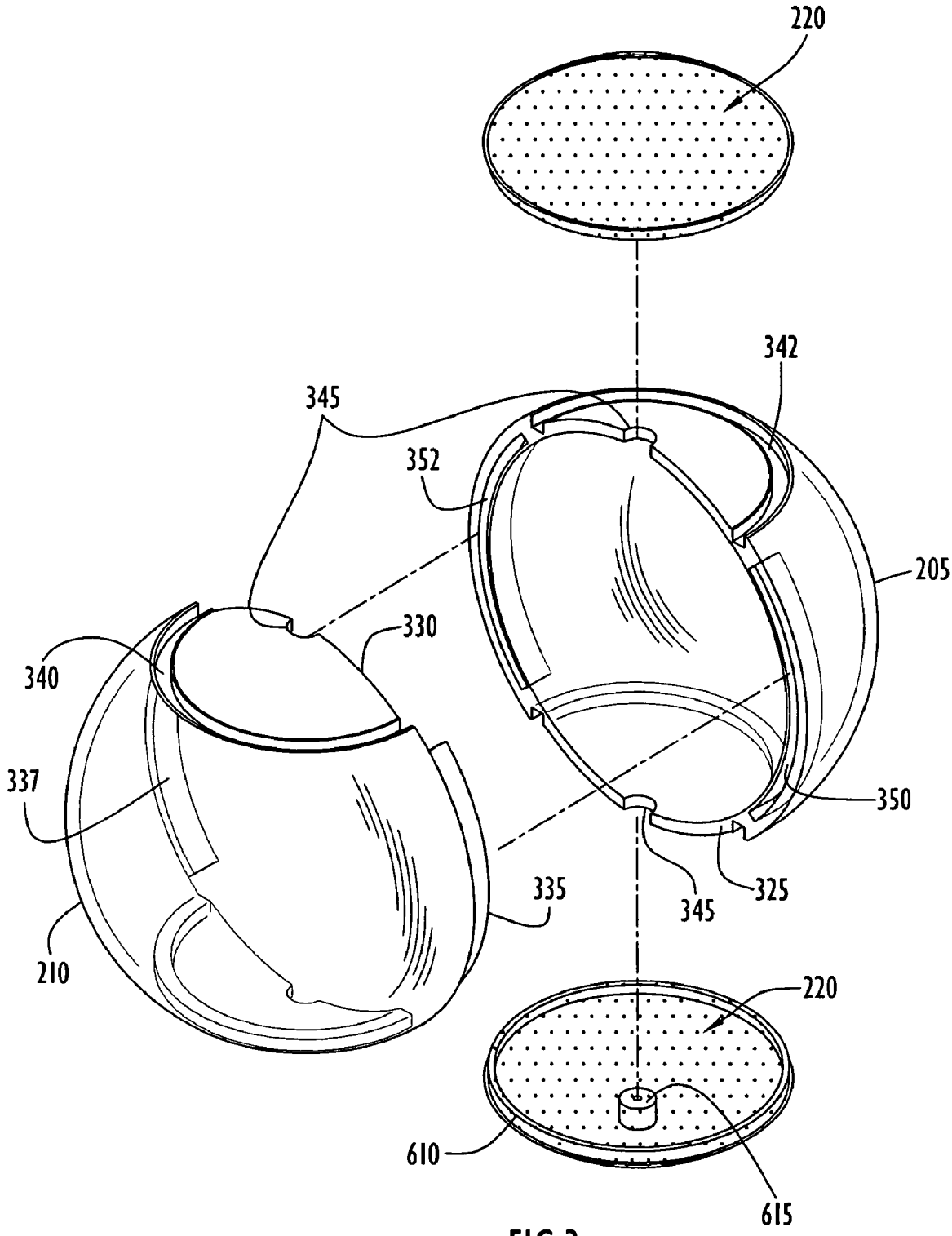
FIG. 3 illustrates an exploded perspective view of the toy ball of FIG. 2 in accordance with the present invention.

A toy ball according to an embodiment of the present invention is illustrated in FIGS. 2 and 3. FIG. 2 illustrates a perspective view of the toy ball according to an embodiment of the invention and FIG. 3 illustrates an exploded perspective view of the embodiment of FIG. 2. As shown in the figures, spherical toy ball 200 is formed from two shells 205, 210 and a pair of lock mechanisms 220. In the illustrated embodiment, shells 205, 210 are hemispherical in shape and, as such, shells 205, 210 form equal halves of spherical toy ball 200. In constructing toy ball 200, first, hemispherical shells 205, 210 are mated together, then lock mechanisms 220 are secured to hemispherical shells 205, 210 to form a substantially smooth surfaced sphere. The surfaces of hemispherical shells 205, 210 are smooth, without any sharps edges. Hemispherical shells 205, 210 and lock mechanisms 220 are preferably made from a thermoplastic material. The resulting hemispherical shells 205, 210 are preferably made from a transparent material allowing one to see through the material and into toy ball 200. In contrast, locking mechanisms 220 may be formed from an opaque material and may vary in color according to the user's preference.

Figure 4:
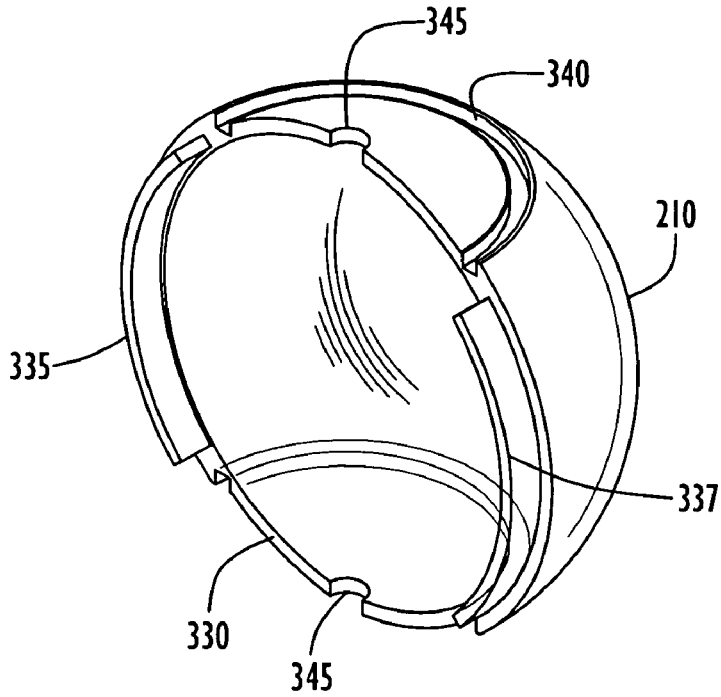
FIG. 4 illustrates a perspective view of one of the shells of the toy ball of FIG. 2.

FIGS. 3 and 4 exemplify the specific construction of toy ball 200 and shells 205, 210 according to a preferred embodiment of the invention. Each of the shells 205, 210 forms one half of a sphere. Hemispherical shells 205, 210 are each hollow, and the surface contours of hemispherical shells 205, 210 terminate at a peripheral edge 325, 330. Each peripheral edge 325, 330 is a surface which is generally perpendicular to the surface contour of hemispherical shells 205, 210. When hemispherical shells 205, 210 are mated together, peripheral edge 325 of hemispherical shell 205 lies substantially flush against peripheral edge 330 of the other hemispherical shell 210 to create a smooth outer junction of hemispherical shells 205, 210. Seam 215 (see FIG. 2) is visible at the meeting plane of peripheral edges 325, 330 along an equator of toy ball 200 once hemispherical shells 205, 210 are joined.

Looking more specifically at hemispherical shell 210 (as best seen in FIG. 4), at least one flange 335 extends from peripheral edge 330. In the preferred embodiment, two flanges 335, 337 are formed on peripheral edge 330 of hemispherical shell 210. Flange 337 is a mirror image of flange 337. Flanges 335, 337 are narrower in thickness than peripheral edge 325 so as to provide a stand off distance along peripheral edge 325 from the inner and outer contoured surfaces of hemispherical shell 210 to the base of flanges 335, 337.

Furthermore, as shown in FIGS. 3 and 4, an arcuate recess 340 is disposed along the outer surface of hemispherical shell 210. Recess 340 originates along peripheral edge 325 and follows an annular, or arcuate, path along the outer surface of hemispherical shell 210 and likewise terminates at peripheral edge 325. In a preferred embodiment, there are two recesses 340 formed on locations diametrically opposed to one another (top and bottom) on hemispherical shell 210. Hemispherical shell 210 also includes semicircular indentation 345 located along peripheral edge 325 generally at the radial center point of each arcuate recess 340.

Referring back to FIG. 3, hemispherical shell 205 is constructed in a complimentary fashion to hemispherical shell 210, thus forming toy ball 200 when the two are mated together. In order to join hemispherical shell 210 to hemispherical shell 205, channels 350, 352 are disposed within hemispherical shell 205 along peripheral edge 325 and extending parallel to the surface contours of hemispherical shell 205. The profiles of channels 350, 352 are configured to receive flanges 335, 337 of hemispherical shell 210, creating a tight fit between flanges 335, 337 and channels 350, 352. In addition, hemispherical shell 205 includes recesses 342 which mirrors recesses 340 on hemispherical shell 210 such that when hemispherical shells 205, 210 are mated together, recesses 340, 342 form complete annular recesses on the surface of toy ball 200.

Hemispherical shell 205 has identical semicircular indentations 345 echoing semicircular indentations 345 of hemispherical shell 210. Once hemispherical shells 205, 210 are joined, semicircular indentations 345 form a circular aperture in the surface of toy ball 200.

While the preferred embodiment includes a hemispherical shell 205 with a pair of channels 350, 352 for receiving a pair of flanges 335, 337 disposed on opposing hemispherical shell 210, an alternate embodiment of the invention contemplates a pair of shells, wherein each shell has one channel and one flange (not shown in the figures). The channel and flange on one shell respectively interacts with an opposing flange and channel on the other shell, the channels and flanges being constructed and fitting together as described above in the prior embodiment. Recesses 340, 342 and semicircular indentations 345 would be constructed in the same manner on this alternate embodiment as with the prior embodiment shown in FIG. 3.

Figure 5:
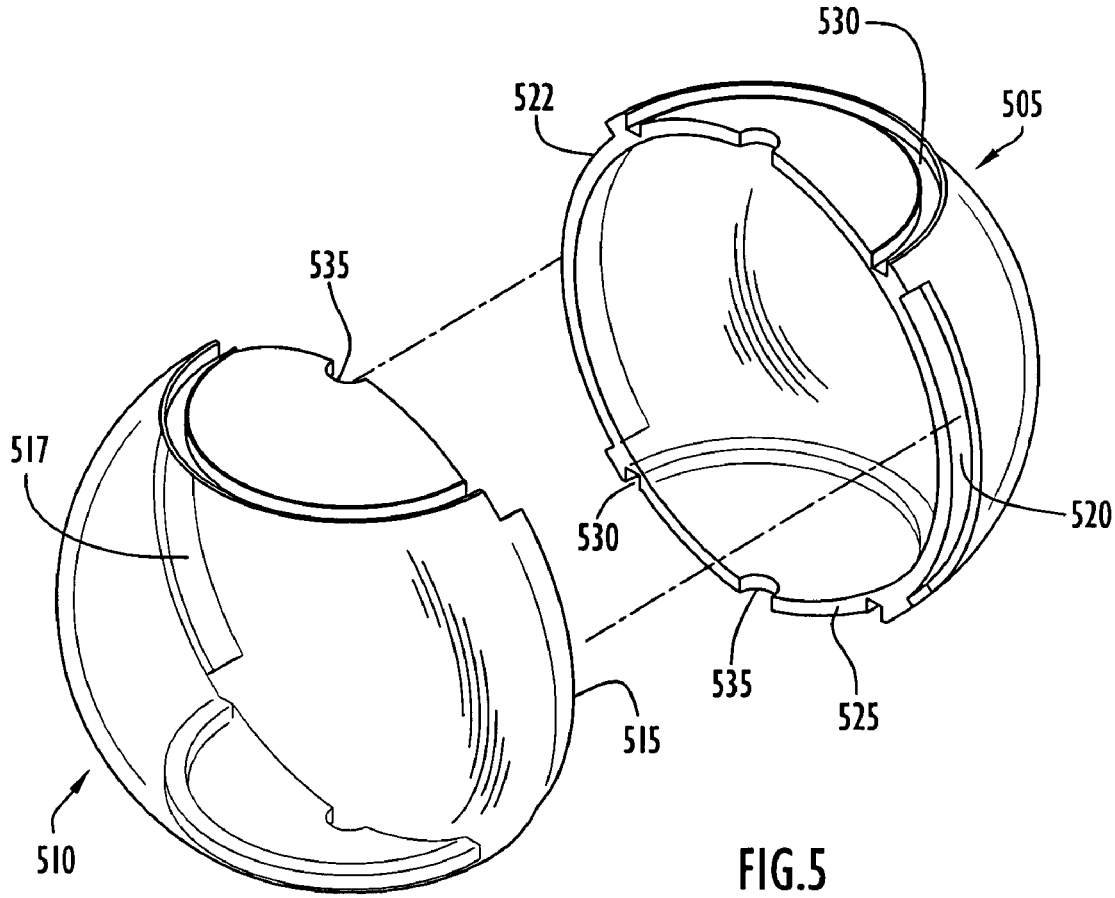
FIG. 5 illustrates an exploded perspective view of the two shells of the toy ball of FIG. 2.

FIG. 5 illustrates yet another embodiment in accordance with the present invention. In this particular embodiment, hemispherical shell 510 has a pair of projections 515, 517 extending from the outer surface of hemispherical shell 510. Opposing hemispherical shell 505 has a corresponding pair of depressions 520, 522 along peripheral edge 525. Projections 515, 517 are received in depressions 520, 522 when hemispherical shells 505, 510 are mated together. Here again, recesses 530 and semicircular indentations 535 are also formed in the same manner as described in the prior embodiment above, and as shown in FIG. 3.

Figure 6:
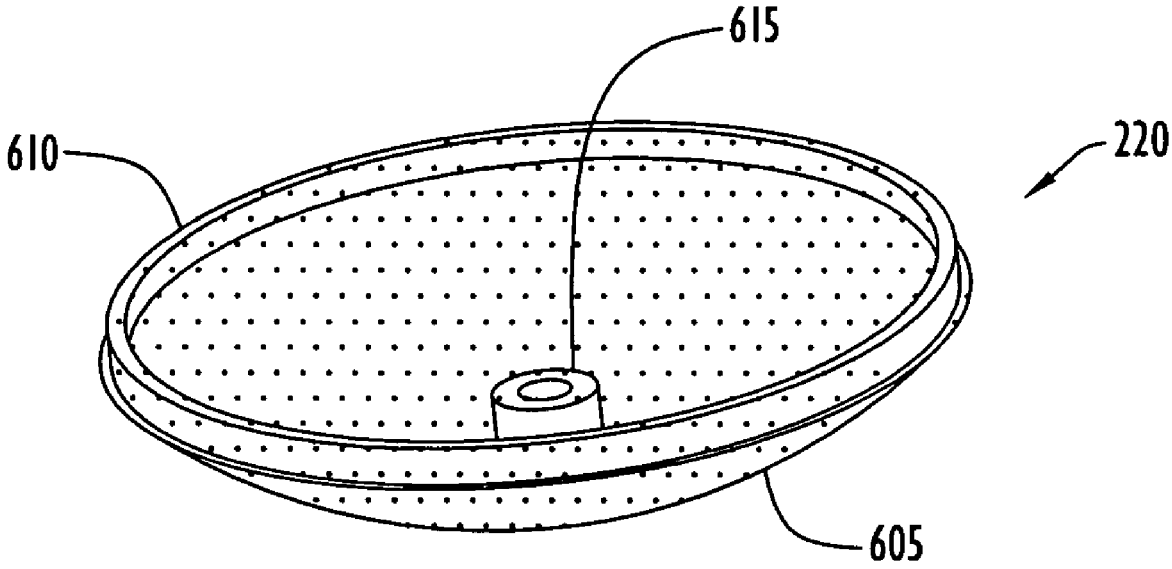
FIG. 6 illustrates a perspective view of one of the lock mechanisms of the toy ball of FIG 2.

The following describes the construction of lock mechanisms 220 and the interaction with hemispherical shells 205, 210 as best seen in FIGS. 3, 6, 7A, and 7B. As shown in FIG. 6, lock mechanisms 220 are generally circular with an outer surface 605 that follows the outer surface contours of hemispherical shells 205, 210 such that when all the elements are put together, a continuous, substantially spherical toy ball 200 is formed. The outer edge of each lock mechanism 220 includes a continuous lip 610 extending inwardly (towards the center of toy ball 200) from outer surface 605 of each lock mechanism 220. The profile of lip 610 is designed to tightly fit in recesses 340, 342 formed on the surfaces of hemispherical shells 205, 210. Furthermore, central boss 615 extends inwardly (towards the center of toy ball 200) from the radial center of lock mechanism 220. Boss 615 has a diameter substantially equal to the circular aperture formed from the combination of semicircular indentations 345 of hemispherical shells 205, 210.

In an alternative embodiment, the boss's cross-sectional profile is of a geometric shape other than a circle (e.g., square, triangle, etc.). In this instance, the aperture formed from the indentations on the hemispherical shells would not be circular but have an outer perimeter substantially the same as the geometric shape of the boss.

Figure 7A:
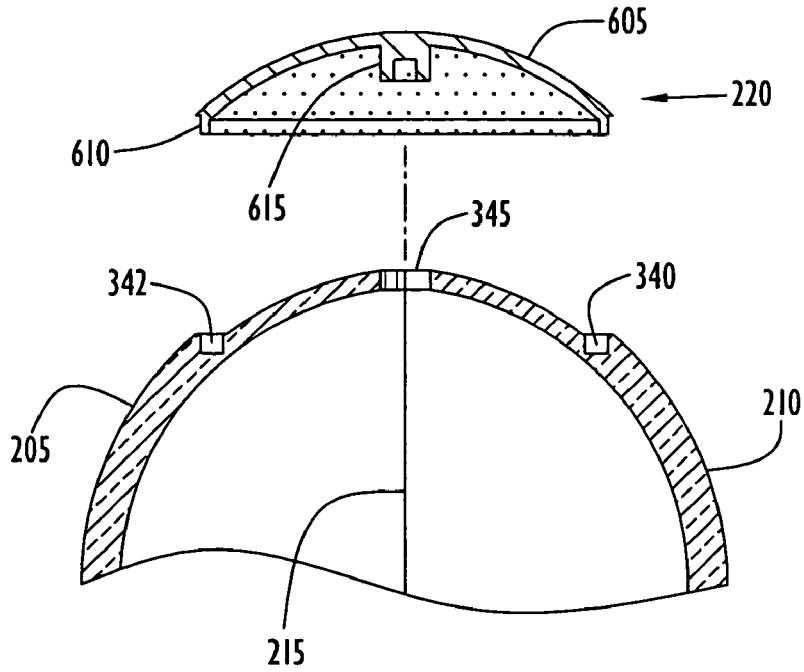
FIG. 7A illustrates an exploded partial cross-sectional side view, taken along line A—A of FIG. 2, of one of the lock devices as it interacts with the two connected shells in accordance with the present invention.
Figure 7B:
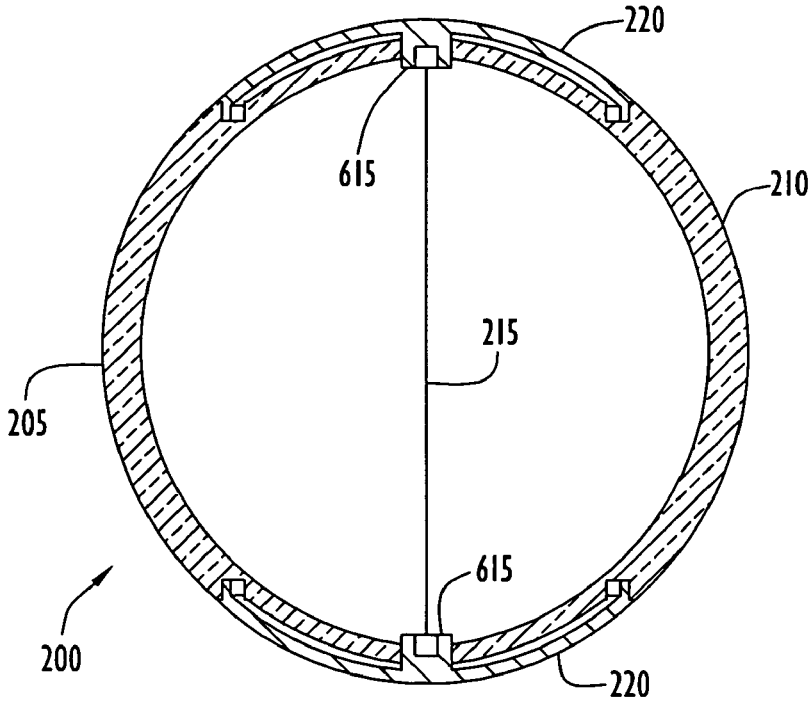
FIG. 7B illustrates a cross-sectional side view taken along line A—A of the toy ball of FIG. 2.

FIGS. 7A and 7B show the interaction of lock mechanism 220 and hemispherical shells 205, 210. Once hemispherical shells 205, 210 are mated together (i.e., flanges 335, 337 are inserted into channels 350, 352) and fused, lock mechanism 220 is positioned and fused in place by fitting lip 610 into recesses 340, 342 and boss 615 in the circular aperture formed from semicircular indentions 345 to produce toy ball 200 as shown in FIG. 7B. The elements of toy ball 200 are fused and held together by any method commonly known to one skilled in the art. The processes can include, but are not limited to, ultrasonic welding, heat sealing, dielectric welding, and chemical bonding. The fusing of hemispherical shells 205, 210 together provides general resistance from breaking. The addition of lock mechanisms 220 adds substantial resistance from fracturing the seals of the hemispherical shells caused by an application of tensile forces acting perpendicular against equatorial seam 215. Lock mechanisms 220 further increase the strength of toy ball 200 by resisting shearing forces acting parallel to equatorial seam 215. Thus, the inclusion of lock mechanism 220 redundantly locks hemispherical shells 205, 210 together along seam 215.

Figure 8A:
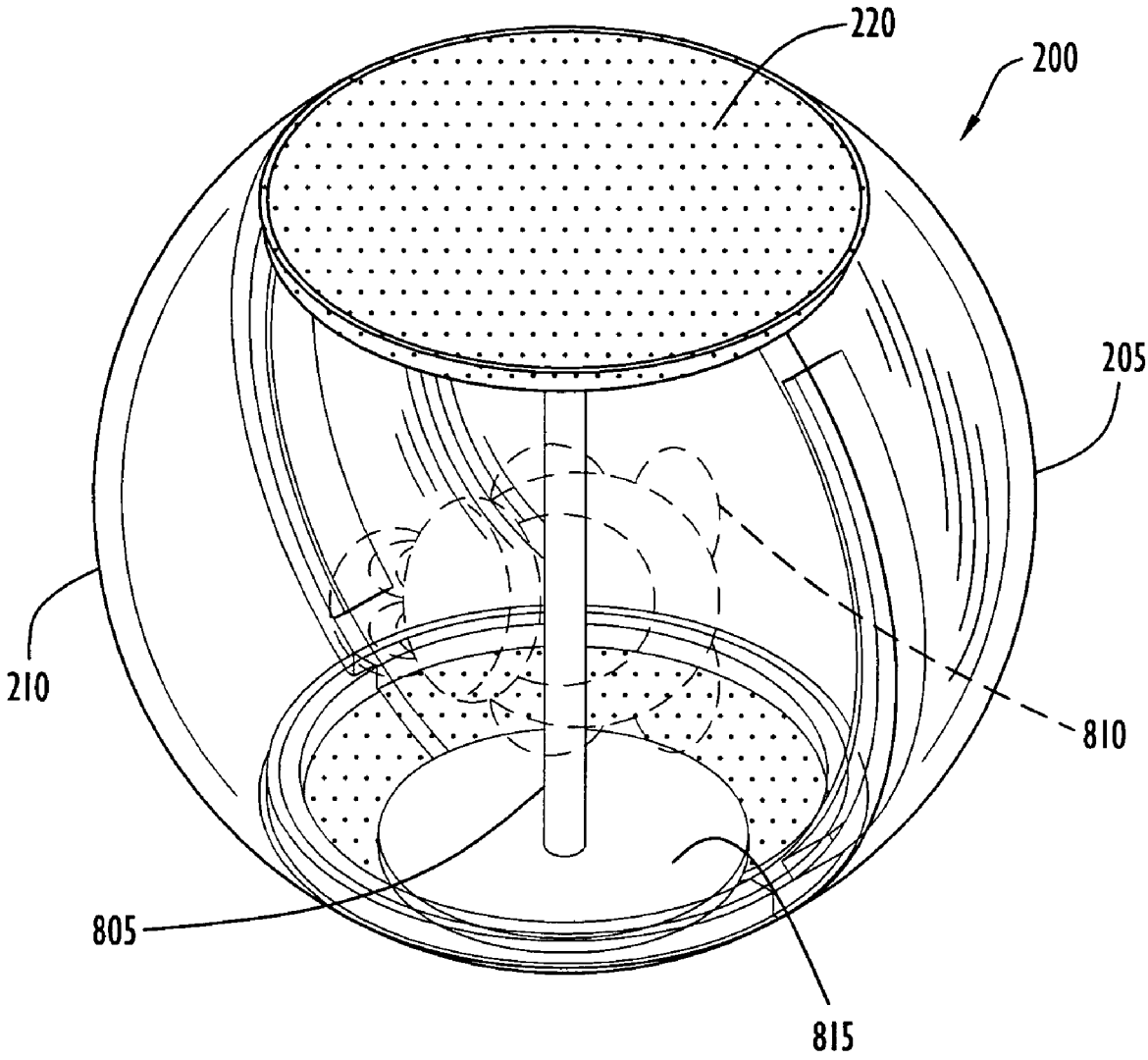
FIG. 8A illustrates a perspective view of another embodiment of the present invention.
Figure 8B:
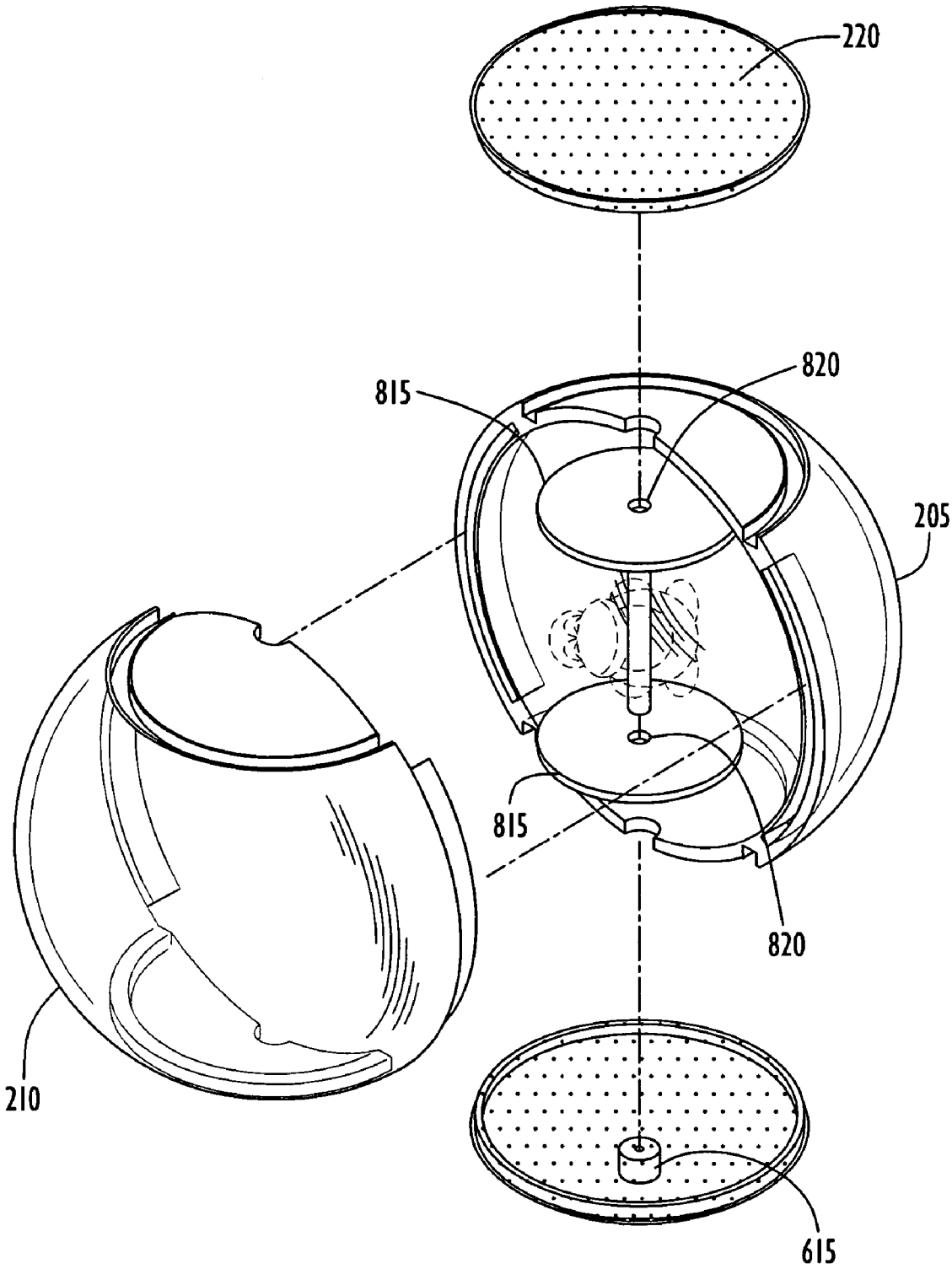
FIG. 8B illustrates an exploded perspective view of the toy ball of FIG. 8A in accordance with the present invention.
Figure 9:
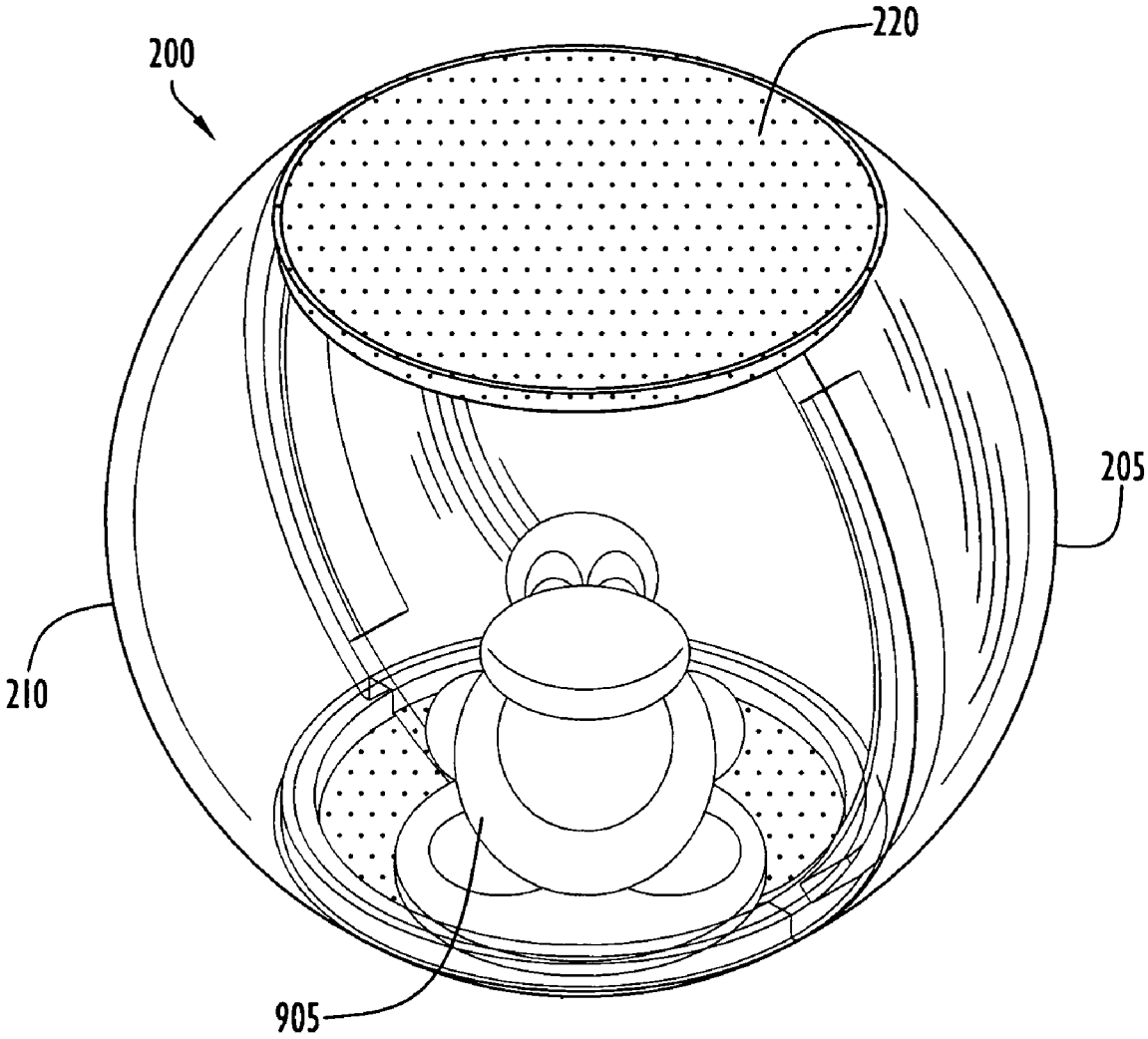
FIG. 9 illustrates a perspective view of yet another embodiment of the present invention.

Prior to assembly of hemispherical shells 205, 210 and locking mechanisms 220, any number of entertainment items may be incorporated into the toy ball as shown in FIGS. 8A, 8B, and 9. For example, FIGS. 8A and 8B illustrate an axle 805 suspended between a pair of floors 815. Fixed or rotatably mounted on the axle 805 is an example of an entertainment feature 810 (shown in dashed lines). As shown in FIG. 8B, floors 815 include circular openings 820 which receive a terminal end of axle 805 for mounting of axle 805 in toy ball 200. Axle 805 and floors 815 are assembled and inserted into the space within hemispherical shells 205, 210 prior to assembly, such that floors 815 are held in place by contact with an interior surface of hemispherical shells 205, 210. Lock mechanisms 220 are then attached, and toy ball 200 with an internal entertainment feature 810 is formed. Alternatively, axle 805 may be directly mounted to bosses 615 of lock mechanisms 220. Similarly, any entertainment item can be employed within toy ball 200. By way of example, FIG. 9 illustrates a figurine 905 disposed freely within the confines of toy ball 200. Hereagain, figurine 905, or other entertainment item, is placed within the hollow interior of hemispherical shells 205, 210 prior to assembly and securing of lock mechanisms 220. In one embodiment, figurine 905 may include a weighted, curved, base which emulates the interior contour of hemispherical shells 205, 210 so that figurine 905 would wobble and slide as toy ball 200 is rolled. Toy ball 200 could also include beads or other freely moveable entertainment features sealed within hemispherical shells 205, 210.

While the invention has been described in detail and with reference to specific embodiments thereof, it will be apparent to one skilled in the art that various changes and modifications can be made therein without departing from the spirit and scope thereof. For example, toy ball 200 might include a lock mechanism where the lip is received in a larger aperture rather than a channel as illustrated in the embodiment described above. Furthermore, indicia may be imprinted on either the inner or outer surface of the shells. Additionally, the lock mechanisms can be formed with tactile features/designs on the exterior surface (e.g., indentations, geometric shapes, bumps, caricatures, etc.). As previously mentioned, the toy balls may include internal entertainment features that are actuated by the reorientation (rolling) of the ball. Furthermore, the spherical toy ball may comprise to shells of unequal size, rather than two hemispherical shells. Thus, it is intended that the present invention cover the modifications and variations of this invention that come within the scope of the appended claims and their equivalents.

We claim:

1. A spherical toy ball, comprising:

first and second shells, wherein said first and second shells are adapted to be connected together along a seam on an outer circumference to form a sphere; and at least one lock mechanism, said at least one lock mechanism adapted to be attached to said sphere such that said lock mechanism covers a portion of said seam and said lock mechanism captures an outer peripheral portion of each of said first and second shells wherein said at least one lock mechanism prevents separation of said first and second shells along said seam.

2. The toy ball of claim 1, wherein said first and second shells and said at least one lock mechanism form a substantially continuous spherical surface.

3. The toy ball of claim 1, wherein said at least one lock mechanism comprises a partially spherical surface.

4. The toy ball of claim 1, wherein said first and second shells are hemispherical shells.

5. The toy ball of claim 1, wherein said first and second shells are transparent.

6. The toy ball of claim 5, wherein indicia is imprinted on at least one of said shells.

7. The toy ball of claim 1, wherein said at least one lock mechanism is opaque.

8. The toy ball of claim 1, wherein a lip is formed along a periphery of said at least one lock mechanism, said lip engaging a corresponding recess on each of said first and second shells.

9. The toy ball of claim 8, wherein said lip is annular and said corresponding recess on each of said first and second shells is annular.

10. The toy ball of claim 1, wherein said at least one lock mechanism includes a boss extending therefrom.

11. The toy ball of claim 10, wherein said first and second shells are adapted to be connected together to form at least one aperture disposed along said seam, and wherein said boss extending from said at least one lock mechanism is adapted to be received in said aperture.

12. The toy ball of claim 1, wherein said first and second shells are adapted to be connected together using a process selected from the group consisting of ultrasonic welding, heat sealing, dielectric welding, and chemical bonding.

13. The toy ball of claim 1, wherein said at least one lock mechanism adapted to be attached to said sphere using a process selected from the group consisting of ultrasonic welding, heat sealing, dielectric welding, and chemical bonding.

14. The toy ball of claim 1, wherein said at least one lock mechanism comprises two lock mechanisms located at diametrically opposite positions with respect to each other on said sphere.

15. The toy ball of claim 14, wherein each of said two lock mechanisms includes a boss extending therefrom.

16. The toy ball of claim 15, wherein an axle is mounted between the bosses extending from said two lock mechanisms.

17. The toy ball of claim 16, wherein an entertainment element is mounted on said axle.

18. The toy ball of claim 1, wherein at least one entertainment item is housed within said sphere.

19. The toy ball of claim 1, wherein said first and second hemispherical shells comprise:

at least one flange extending along a peripheral surface of said first shell, said flange following a surface contour of said first shell; and at least one channel disposed in a peripheral surface of said second shell, said channel configured to receive said flange when said first and second shells are connected together.

20. The toy ball of claim 19, wherein said first shell has at least two flanges, and said second shell has at least two channels.

21. A method of constructing a spherical toy ball, the method comprising the steps of:

connecting first and second shells together along a seam on an outer circumference to form a sphere; and attaching at least one lock mechanism to said sphere such that said at least one lock mechanism covers a portion of said seam and said at least one lock mechanism captures an outer peripheral portion of each of said first and second shells wherein said at least one lock mechanism prevents separation of said first and second shells along said seam.

22. The method of constructing a toy ball of claim 21, further comprising the step of forming said first and second shells from a transparent material.

23. The method of constructing a toy ball of claim 21, further comprising the step of forming said first and second shells as first and second hemispherical shells.

24. The method of constructing a toy ball of claim 22, further comprising the step of printing indicia on at least one of said shells.

25. The method of constructing a toy ball of claim 21, further comprising the step of forming said at least one lock mechanism from an opaque material.

26. The method of constructing a toy ball of claim 21, further comprising the steps of:

forming a lip along a periphery of said at least one lock mechanism; and engaging said lip with a corresponding recess on each of said first and second shells.

27. The method of constructing a toy ball of claim 21, further comprising the step of forming a boss extending from said at least one lock mechanism.

28. The method of constructing a toy ball of claim 27, further comprising the steps of:

forming at least one aperture disposed along said seam; and engaging said at least one aperture with said boss extending from said at least one lock mechanism.

29. The method of constructing a toy ball of claim 21, further comprising the step of connecting said first and second shells using a process selected from the group consisting of ultrasonic welding, heat sealing, dielectric welding, and chemical bonding.

30. The method of constructing a toy ball of claim 21, further comprising the step of attaching said at least one lock mechanism to said sphere using a process selected from the group consisting of ultrasonic welding, heat sealing, dielectric welding, and chemical bonding.

31. The method of constructing a toy ball of claim 21, further comprising the step of securing a pair of said lock mechanisms at diametrically opposite positions with respect to each other on said sphere.

32. The method of constructing a toy ball of claim 31, further comprising the step of mounting an axle between said pair of lock mechanisms.

33. The method of constructing a toy ball of claim 32, further comprising the step of mounting an entertainment element on said axle.

34. The method of constructing a toy ball of claim 21, further comprising the step of housing at least one entertainment item within said sphere.

35. The method of constructing a toy ball of claim 21, further comprising the steps of:

forming at least one flange along a peripheral surface of said first shell, said flange following a surface contour of said first shell; and forming at least one channel in a peripheral surface of said second shell, configuring said channel to receive said flange when said first and second shells are connected together.

36. The method of constructing a toy ball of claim 35, further comprising the steps of:

forming at least two flanges on said first hemispherical shell;

forming at least two channels on said second shell; and configuring said at least two channels to receive said at least two flanges when said first and second shells are connected together.

* * * * *